United States Patent [19]

Goloskov et al.

[11] 4,145,174

[45] Mar. 20, 1979

[54] ROTARY TABLETTING MACHINE

[75] Inventors: Emmanuil I. Goloskov; Isaak M. Kott; Genrikh A. Maevsky; Mikhail P. Pinchuk; Anatoly P. Pljuschev; Vladimir I. Terlo, all of Leningrad, U.S.S.R.

[73] Assignee: Leningradskoe spelsialnoe konstruktorskoe bjuro polimernogo masinostroenia, U.S.S.R.

[21] Appl. No.: 877,945

[22] Filed: Feb. 15, 1978

[51] Int. Cl.[2] ..... B30B 11/08

[52] U.S. Cl. ..... 425/78; 425/145; 425/146; 425/354

[58] Field of Search ..... 425/78, 145, 146, 354, 425/352, 353, 355

[56] References Cited

U.S. PATENT DOCUMENTS

| | | | |
|---|---|---|---|
| 3,398,435 | 8/1968 | Nouel | 425/146 X |
| 3,524,220 | 8/1970 | Davison | 425/78 |
| 3,611,517 | 10/1971 | Giersberg et al. | 425/354 X |
| 3,890,413 | 6/1975 | Peterson | 425/78 X |
| 3,918,873 | 11/1975 | Crossley et al. | 425/353 X |
| 3,938,920 | 2/1976 | Fleissner | 425/78 |
| 4,000,231 | 12/1976 | Peterson | 425/78 X |

*Primary Examiner*—J. Howard Flint, Jr.
*Attorney, Agent, or Firm*—Steinberg & Blake

[57] ABSTRACT

A rotary tabletting machine comprises a rotor with press tools for compression of tablets arranged around the periphery thereof. Pressure rolls contacting said press tools are mounted on both sides of the rotor. The machine is provided with a means for batching tablet material, a means for controlling said means for batching tablet material, and a hydraulic stabilizer of compressive pressure. The hydraulic stabilizer is equipped with a hydraulic pressure regulator connected with said controlling means and incorporating a check valve, a hydraulic damper and a capillary, the inlet of said check valve being coupled to the hydraulic stabilizer, and the outlet thereof being coupled to said controlling means through the hydraulic damper and to a drain through the capillary.

1 Claim, 4 Drawing Figures

ROTARY TABLETTING MACHINE

The present invention relates generally to machines for making tablets from various materials, and more particularly to rotary tabletting machines.

The present invention can be most advantageously used in processing plastic materials, in chemical, pharmaceutical, electronical, electrical and food inductries, as well as in powder metallurgy in the manufacture of a large variety of products: either half-finished products to be further processed, such as tablets made from thermosetting plastics, or finished products, such as medicinal tablets and tablets from powder catalysts. The present invention may also be used in the electronical industry for the manufacture of disk resistors.

The main requirement imposed upon rotary tabletting machines is making tablets of a mass but slightly different from a predetermined value. The mass of the tablet approaching the minimum allowable limit of a predetermined value permits production of a larger quantity of tablets out of the same amount of material, which results in saving of the material being processed.

Therefore, the principal approach to the design of such machines is to provide them with system for automatic control of the tabletting process, in particular, systems for automatically maintaining the compressive pressure which is a function of the amount of tablet material in the rotary machine die.

The demand of such systems arises due to the fact that during operation of the machine, the material supplied for processing forms part of different delivery lots and may vary in grading, moisture content and friability. Even the slightest variation of these physical and mechanical properties of the material results in a change in the amount of the material supplied to the die for a specified operating mode of the machine, thus influencing the mass of the tablet, hence the compressive pressure.

In prior art rotary tabletting machines there are provided means for maintaining a constant mass of the tablets, allowing control of the die capacity, and consequently the amount of the material charged, by adjusting the dosage can in response to the change in compressive pressure.

A rotary tabletting machine is known (cf. German Pat. No. 1627927) provided with an automatic system for maintaining the constant mass of the tablets, its operating being based on the use of a spring-loaded stabilizer of the compressive pressure cooperating with a movable lever of a pressure roll. Maximum permissible displacements of the lever dependent on the compressive pressure are adjusted by two limit switches built in the transmission chain of a cam batching mechanism. During operation of the machine, the lever is caused to shift under control of the compressive pressure against the resistance of the pressure stabilizer spring. As the compressive pressure deviates both ways from the allowable value, the lever is moved to close one of the limit switches and actuate, as a result, the drive of the cam batching mechanism.

The disadvantage of such an arrangement resides in a low sensitivity of the measuring system, hence low accuracy of maintaining constant tablet mass. Also, the lower pressure roll of such machines is repeatedly displaced as the compressive pressure varies, resulting in vibrations and additional dynamic load on the machine mechanism.

Further, such an arrangement for control of the tablet mass can only be employed in tabletting machines with low compressive pressures, where spring-loaded pressure stabilizers are used. In the present tabletting machines exhibiting high values of compressive pressures, these disadvantages are eliminated to a certain extent through the use of hydraulic stabilizers. In such tabletting machines, the pressure roll coupled to the hydraulic pressure stabilizer is essentially fixed.

One such machine (cf. U.S. Pat. No. 3,255,716, Cl. 107-17) comprises a rotary table with press tools for forming tablets, arranged around the periphery thereof, pressure rolls disposed on both sides of the rotary table for cooperation with press tools, a hydraulic compressive pressure stabilizer, an automatic system for batching tablet material, which includes strain gauges to sense the compressive pressure from the press tool, a circuit for comparing the measured compressive pressure with a predetermined one, and an actuator.

Such a rotary tabletting machine, however, has a drawback residing in the complexity of its automatic batching system for conversion of signals from the strain gauges to actuate the drive for displacement of a batching cam. This arrangement comprises a rather sophisticated multi-element electric circuit including such units as a DC amplifier, a measured-to-reference signal comparator, a dc-to-pulsed signal converter, etc., and requiring a fine tuning. Low reliability of such a device is caused by its excessive complexity.

The main object of the present invention is to provide a rotary tabletting machine in which it is possible, by simple and reliable means, to ensure the stable maintaining of the constant mass of tablets being produced, while keeping low weight tolerances.

A further object of the present invention is to provide a rotary tabletting machine which enables savings of basic tablet material.

With these and other objects in view, there is proposed a rotary tabletting machine comprising a rotor with press tools for compression of tablets, arranged around the periphery thereof, pressure rolls disposed on both sides of the rotor and cooperating with press tools, a tablet material batching mechanism, a means for controlling the batching mechanism, a hydraulic stabilizer of the compressive pressure, in which, according to the invention, the hydraulic stabilizer is provided with a hydraulic regulator of the compressive pressure connected with the means for controlling the batching mechanism and including a check valve, a hydraulic damper, and a capillary, the check valve having an inlet connected to the hydraulic stabilizer and an outlet connected to the means for controlling the batching mechanism through the hydraulic damper and to a drain through the capillary, thus making it possible to average peak values of pulsed compressive pressures.

Such construction of the rotary tabletting machine wherein connected with its hydraulic stabilizer of the compressive pressure is a hydraulic system serving to feed an average signal of compressive pressure, applied to the means for controlling the batching mechanism, provides a reliable stabilization of compressive pressure and, ultimately, a stable maintenance of the mass of tablets being formed. Moreover, such a design considerably simplifies the batching system of the rotary tabletting machine and, consequently, the construction of the entire machine, since in this case it obviates the need of using strain gauges or some other inertia-free pressure-sensitive means for sensing the signals corresponding to pulsed compressive pressures. The provision of such sensors necessitates a special mechanical design of the compression assembly, resulting in a more complicated machine.

Furthermore, the realization of the hydraulic regulator of compressive pressure as a hydraulic system consisting of a check valve, a hydraulic damper, and a capillary, makes it possible to obtain an excellent simplicity and reliability whereby such a regulator can be readily mounted on any rotary tabletting machine having a hydraulic stabilizer of the compressive pressure.

Features and advantages of the present invention will become apparent from the following detailed description with reference to the accompanying drawings, in which.

Figure 1:
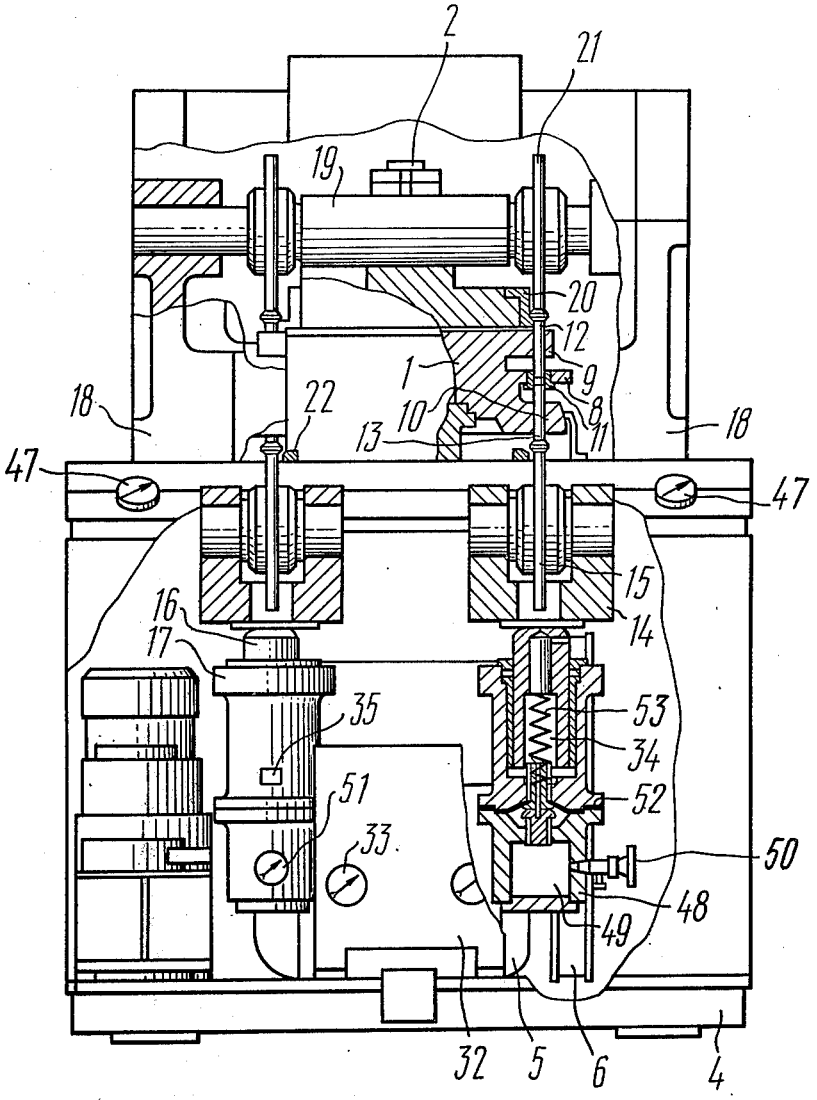
FIG. 1 is a front elevation of the rotary tabletting machine, in accordance with the invention, partially in section.
Figure 2:
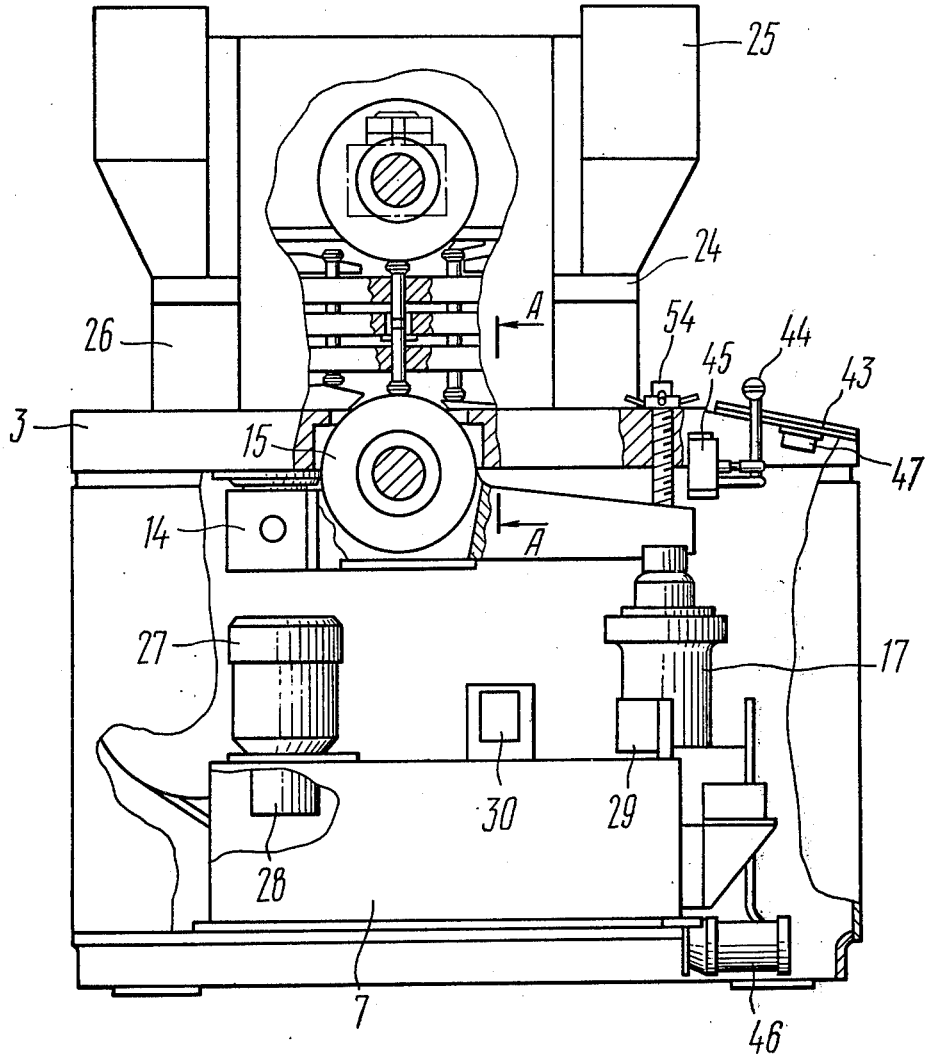
FIG. 2 is a left side elevation of the rotary tabletting machine, in accordance with the invention, partially in section.

The machine comprises a rotor 1 (FIG. 1) fitted on an axle 2 secured to a plate 3 (FIG. 2) mounted on a frame 4. Also mounted on the frame 4 is a drive 3 (FIG. 1) of the rotor 1, with a variator 6, and a pumping unit 7. The rotor 1 consists of a die table 8, an upper shelf 9, and a lower shelf 10. Provided at the periphery of the die table 8 parallel to the axle 2 are holes in which dies 11 are received, while at the periphery of the upper shelf 9 and the lower shelf 10, coaxially with the dies 11, there are provided guide holes where upper punches 12 and lower punches 13, respectively, are mounted which, combined with the dies 11, make up the press tool for compression of tablets.

This rotary tabletting machine is a double-action machine, i.e. during revolution of the rotor, each pair of punches form two tablets at a time. Therefore, it is clear that identical members performing the same function are provided in duplicate at each station.

Levers 14 with lower pressure rolls 15 are articulated to the plate 3 from below at one end, while at the other end they bear against piston rods 16 of hydraulic stabilizers 17 for stabilization of compressive pressure.

Disposed on top of the plate 3 are posts 18 tied by a cross-piece 19. The upper end of the axle 2 and upper master forms 20 are secured to the cross-piece 19. The cross-piece 19 also serves as an axle on which upper pressure rolls 21 are mounted.

Figure 3:
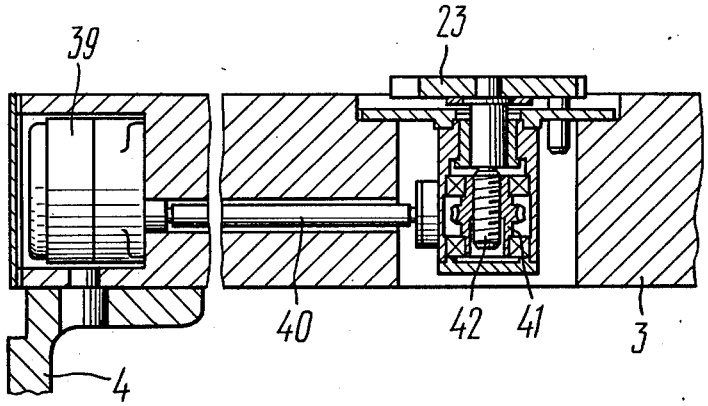
FIG. 3 is a vertical section of a batching mechanism taken along the line A — A in FIG. 2.

Secured to the plate 3 under the lower shelf 10 of the rotor 1, concentrically with the axis 2, are lower master forms 22 and batching cams 23 (FIG. 3) for controlling the amount of tablet material supplied to the dies 11.

In the filling zone of the dies 11 above the die table 8, there are disposed feeders 24 with hoppers 25. The feeders 24 are supported on feet 26 attached to the plate 3.

The pumping station 7 is equipped with an electric motor 27 with a pump 28, capillaries 29, a safety valve 30, and check valves 31.

Secured to the frame 4 is a panel 32 with pressure gauges 33 mounted thereon to deliver an electric signal proportional to the value of pressure in a chamber 34 under the rods 16 of the stabilizers 17. The inlets of the check valves 31 are connected to the chambers 34.

Figure 4:
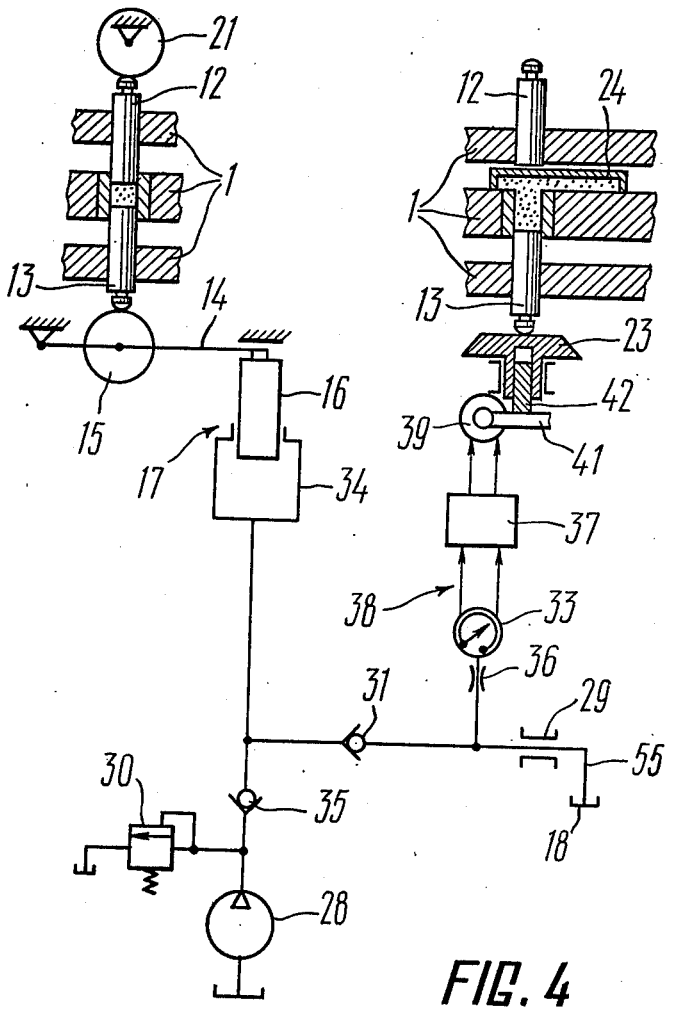
FIG. 4 is a kinematic chain of the rotary tabletting machine.

For refilling the hydraulic system, the chambers 34 of the hydraulic stabilizers 17 are coupled to the pumps 28 through check valves 35 (FIG. 4).

The outlets of the check valves 31 are connected to hydraulic dampers 36 and to a drain through the capillaries 29.

The dampers 36, in turn, are connected to the pressure gauges 33. The outputs of the pressure gauges 33 are coupled each to its respective setting device 37 (FIG. 4) to form means 38 for controlling the batching cams 23. The outputs of the setting devices 37 of the means 38 are fed back to electric motors 39 (FIG. 3) of the drive for the batching cams 23 which cams are built in the plate 3 and connected to the electric motors 39 by shafts 40, worm gears 41 and screws 42.

A control board 43 (FIG. 2) has a knob 44 of a control valve 45 for controlling a hydraulic motor 46 of a screw drive (not shown) of the speed variator 6, and pressure gauges 47 for visually checking the pressure in the chambers 34.

The compressive pressure hydraulic stabilizer 17 also functions as a safety means responsive to a compressive pressure in excess of maximum value allowable for the machine. To this end, it incorporates a cup 48 with its cavity 49 filled with gas under pressure corresponding to maximum allowable pressure in the hydraulic system of the machine. A valve 50 serves for connection of a gas bottle (not shown) to fill the cavity 49, while a pressure gauge 51 is used for checking the gas pressure in the cavity 49.

The cavity 49 is separated from the chamber 34 by a rubber diaphragm 52.

A spring 53 disposed in the chamber 34 serves for providing a continuous contact of the lever 14 with a threaded stop 34 (FIG. 2) which serves to adjust the tablet height and fix the upmost position of the lower pressure roll 15.

A drainage system 55 is provided for discharge through the capillaries 29.

The operation of the machine is as described below.

By adjusting the batching cam 23, a pre-set batch weight for a tablet is set. Moving the lever 14 by means of the threaded stop 54, a predetermined compressive pressure is set on the pressure gauge 47 so as to obtain a tablet of a described height. The setting device 37 is adjusted to proper minimum and maximum values of compressive pressure, i.e. those pressures which are to be controlled in the chambers 34 of the hydraulic stabilizer 17.

The machine is then started, and the drive 5 rotates the rotor 1 about the axle 2 through the speed variator 6 and a reduction gear (not shown). Thus, the upper punches 12 and the lower punches 13 are verically displaced following the profile of the upper master forms 20 and the lower master forms 22 they engage. The master forms 20 and 22 define the complete cycle of tablet manufacture from charging the tablet material into the dies 11 as they pass under the feeder 24., batching the amount of material as they engage the batching cam 23, and to the ejection of the finished tablet from the die 11 to the surface of the die table 8.

The tablet is compressed in the dies 11 by the punches 12 and 13 as they pass between the pressure rolls 15 and 21.

At any given point of the compression operation, pressure pulses proportional to the compressive pressure are generated in the chamber 34 of the hydraulic stabilizer 17. As this takes place, the check valve 35 is closed, since the additional feeding pressure provided by the pump 28 is lower than the pressure in the chamber 34 produced by compression. The check valve 31 will keep on passing the pressure pulses until the pressure in the system connected to its outlet becomes equal to the compressive pressure. In this case, the check valve 31 will prevent a single pulse smaller than the preceding one from reaching the pressure gauge 33, while a single pulse greater than the preceding one will also be inhibited by the damper 36 and the capillary 29. Thus spurious pulses are not registered by the pressure gauge 33. This feature is one of the advantages of the present invention, since the combination of hydraulic elements, i.e. the check valve 31, hydraulic damper 36 and capillary 29, comprises a simple and reliable hydraulic regulator which makes it possible to average peak values of compressive pressure thus preventing spurous the batching mechanism.

With a steady over- and undercharge of the die 11 with powder, pulses other than the pre-set ones are generated. If new pulses are of a value lower than that of the preceding ones, the pressure in the system downstream the outlet of the check valve 31 decreases due to leakages through the drain system 54 (FIG. 4) of the capillary 29. This compressive pressure drop is sensed by the pressure gauge 33 which feeds a signal to the setting device 37. If the value registered by the means 38 for controlling the batching mechanism is lower than the pre-set one, a command to start the electric motor 39 for the drive of the cam 23 is fed to lower the cam and to increase the amount of the material charged.

If the pressure pulses are greater than the preceding ones, the pressure in the system downstream the outlet of the check valve 31 increases and is registered by the means 38 for controlling the batching mechanism. If the value registered by the means 38 is greater than the pre-set one, then a signal to start the electric motor 39 for the drive of the batching cam 23 is applied, to lift the cam and to reduce the amount of tablet material charged.

The amount of tablet material charged is adjusted until the compressive pressure value falls within the limits pre-set by the setting device 37 of the means 38.

It is to be understood that the preferred embodiment of the present invention herein described is merely illustrative of a specific design of the rotary tabletting machine, as it will be apparent to those skilled in the art that other modifications and variations of the present invention are possible without departing from the spirit and scope thereof as set forth in the following claims.

We claim:

1. In a rotary tabletting machine comprising a rotor, press tools arranged around the periphery of said rotor, pressure rolls disposed on both sides of said rotor, a means for batching tablet material, a means for controlling said means for batching tablet material, and a hydraulic stabilizer of compressive pressure, an improvement consisting in that said hydraulic stabilizer of compressive pressure incorporates a hydraulic regulator of compressive pressure connected with said controlling means and including a check valve, a hydraulic damper, and a capillary, an inlet of said check valve being connected to said hydraulic stabilizer, and an outlet being connected to said means for controlling through said hydraulic damper and to a drain through said capillary.

* * * * *